United States Patent [19]

Bayh, III

[11] Patent Number: 4,913,239

[45] Date of Patent: Apr. 3, 1990

[54] SUBMERSIBLE WELL PUMP AND WELL COMPLETION SYSTEM

[75] Inventor: Russell I. Bayh, III, Carrollton, Tex.

[73] Assignee: Otis Engineering Corporation, Dallas, Tex.

[21] Appl. No.: 357,188

[22] Filed: May 26, 1989

[51] Int. Cl.[4] ..... E21B 19/02; E21B 34/10; E21B 43/12

[52] U.S. Cl. ..... 166/385; 166/65.1; 166/66.4; 166/105; 166/382

[58] Field of Search ..... 166/68, 66.4, 65.1, 166/104, 105, 105.5, 106, 107, 382, 385; 174/70 R, 28, 24; 417/360, 423.3, 423.13

[56] References Cited

U.S. PATENT DOCUMENTS

| | | | |
|---|---|---|---|
| 4,013,538 | 3/1977 | Schneider et al. | 166/65.1 X |
| 4,128,127 | 12/1978 | Taylor | 166/105 |
| 4,363,359 | 12/1982 | Taylor et al. | 166/214 |
| 4,425,965 | 1/1984 | Bayh, III et al. | 166/106 |
| 4,502,536 | 3/1985 | Setterberg | 166/105.5 |
| 4,589,482 | 5/1986 | Bayh | 166/105.5 |
| 4,611,656 | 9/1986 | Kendall, Jr. et al. | 155/65.1 |
| 4,619,323 | 10/1986 | Gidley | 166/65.1 X |
| 4,625,798 | 12/1986 | Bayh | 166/106 |
| 4,667,737 | 5/1987 | Shaw et al. | 166/104 |
| 4,716,260 | 12/1987 | Hoffman et al. | 174/102 R |
| 4,740,658 | 4/1988 | Hoffman et al. | 174/103 |
| 4,749,341 | 6/1988 | Bayh | 417/360 |

OTHER PUBLICATIONS

Completion Capabilities of a New Cable Deployed Electric Submersible Pumping System for Enhanced Oil Production Petroleum Society of CIM Paper No. 89-40-13.

*Primary Examiner*—Stephen J. Novosad
*Attorney, Agent, or Firm*—Thomas R. Felger

[57] ABSTRACT

A submersible well pump and downhole completion system. The system includes a fluid flow path from the well surface to inject lubricating fluid to increase downhole pump life and/or corrosion inhibitors to protect downhole components from potentially harmful well fluids. The system substantially increases the service life of downhole components used to enhance the production of well fluids. The system also offers ease of assembly at the well surface and installation at the desired downhole location.

10 Claims, 5 Drawing Sheets

SUBMERSIBLE WELL PUMP AND WELL COMPLETION SYSTEM

BACKGROUND OF THE INVENTION

1. Field of the Invention

This invention relates to submersible well pumps and particularly to increasing the downhole service life of the pump motor and related equipment.

2. Description of the Relevant Art

Submersible pumps have been installed at preselected downhole locations in well bores by various well completion systems and techniques. Some examples include:

- attaching the pump to the production tubing string as shown In U.S. Pat. Nos. 4,502,536 and 4,589,482;
- suspending the pump from its power cable as shown in U.S. Pat. Nos. 4,128,127 and 4,363,359;
- supporting the pump on a well packer or similar downhole resting place as shown in U.S. Pat. No. 4,625,798; or
- releasably anchoring the pump in a downhole landing nipple as shown in U.S. Pat. No. 4,749,341;

The present invention resulted from design, manufacture, and testing of equipment shown in U.S. Pat. No. 4,749,341. The preferred power cable for use with the present invention is shown in U.S. Pat. No. 4,740,658. Other power cables could be modified for use with the present invention such as the cable shown in U.S. Pat. No. 4,716,260.

The preceding patents are incorporated by reference for all purposes within this application.

SUMMARY OF THE INVENTION

The present invention discloses a well completion with a submersible pump and power cable. In addition to electrical energy to operate the pump, the power cable also supplies fluid to lubricate and/or protect the pump motor and related downhole components from potentially harmful well fluids. The pump, its prime mover (an electric motor), and related components have a flow path to receive fluids such as lubricating oil, corrosion inhibitor, purge fluids, etc. from the well surface. The power cable is used to install and remove the pump and related components from a selected downhole location defined in part by a landing nipple.

An object of this invention is to provide a method and system for releasably anchoring a submersible pump with its power cable at a downhole location in a well bore defined in part by a landing nipple in a production tubing string. The power cable extends upwardly and if desired may be placed in tension above the pump to prevent damage to the cable.

Another object is to provide a locking module assembly and discharge head with a collet, which releasably engages a groove or grooves in a landing nipple. The collet is more difficult to pull out of the groove than to insert into the landing nipple, so that the cable may be placed in tension if desired to protect the cable from damage without releasing the locking module assembly.

Another object is to provide a locking module assembly for supporting a pump in which the locking module assembly is releasably latched against relative rotation and a cable anchor assembly which connects the power cable to an electric motor in a manner to prevent relative rotation between the cable and motor. The cable anchor assembly prevents damage to electrical and fluid conductors which are positioned exterior to and extend from the power cable to the motor.

Another object is to provide fluid coductors and a fluid flow path to direct fluid from the well surface via the power cable to the pump motor and related downhole components. Fluid from the well surface may be used to:

- lubricate the downhole equipment;
- purge well fluids from the downhole equipment; and/or
- inject corrosion inhibitor to protect the downhole equipment and production tubing string from potentially harmful well fluids.

Additional objects and advantages of the invention will be readily apparent to those skilled in the art from reading the following description in conjunction with the drawings and the claims.

DESCRIPTION OF THE PREFERRED EMBODIMENTS

The invention will be described with respect to electric submersible pumps. However, the principal features of the invention (lubrication of moving components, protection of downhole components from potentially harmful well fluids, ease of assembly and installation) could be used with other downhole submersible pumps. Examples of such pumps include hydraulically powered turbine pumps, hydraulically powered reciprocating pumps, and mechanically powered pumps.

Figure 1:
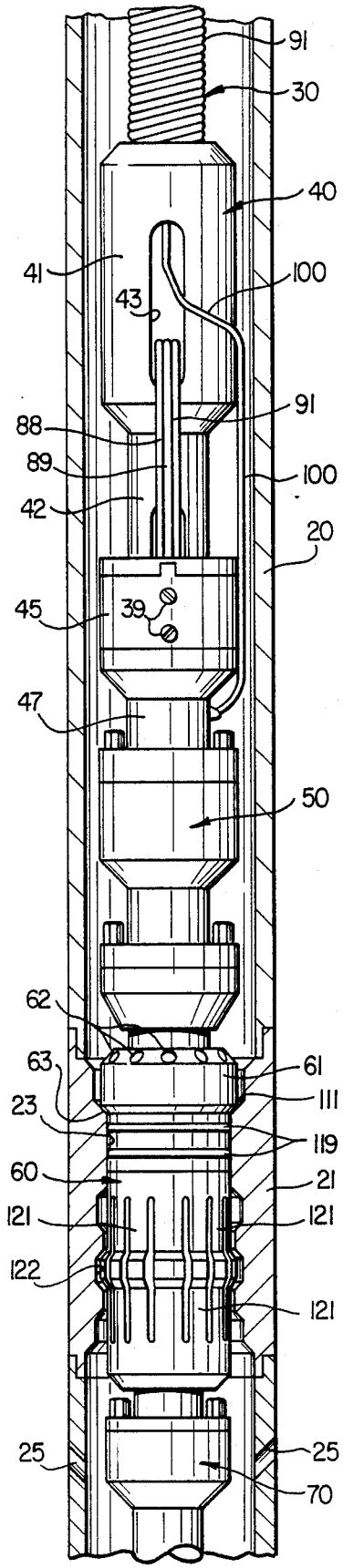
FIG. 1 is a schematic view, partially in longitudinal section and partially in elevation, showing a well completion with a submersible pump and related downhole equipment incorporating the present invention.

FIG. 1 shows a portion of a well completion which includes production tubing string 20 and landing nipple 21 as an integral part thereof. Production tubing string 20 will typically be concentrically disposed within a casing string (not shown). A typical casing string essentially defines the well bore and extends from a wellhead and Christmas tree (not shown) at the well surface to an underground hydrocarbon producing formation (not shown). Perforations (not shown) extend through the casing to allow fluid communication between the interior of the casing and the hydrocarbon producing formation adjacent thereto. A production well packer (not shown) is typically installed in the casing string above the perforations to direct well fluid flow from the hydrocarbon producing formation to the well surface via production tubing string 20. Surface controlled subsurface safety valves, additional well packers, and other flow control devices may be included as an integral part of tubing string 20. Examples of such well completions with a wide variety of available downhole equipment are shown in more detail in U.S. Pat. Nos. 4,625,798 and 4,749,341.

Landing nipple 21 partially defines the downhole location for releasably anchoring submersible pump 70 and related components within the well bore. Submersible pump 70 and its prime mover (electric motor 50) are suspended from power cable 30 within tubing string 20. Power cable 30 is preferably a multiconductor multiwire rope cable which can supply both electrical power and fluid from the well surface to submersible pump 70 and electric motor 50. Power cable 30 can also be used to insert and retrieve submersible pump 70, electric motor 50, and related components from the selected downhole location.

Threads 71 are provided on the extreme lower end of pump 70 to attach additional downhole tools thereto. Examples of such tools include subsurface safety valves, seal units, and inlet piping. Ports 25 are shown in tubing 20 below landing nipple 21 to allow gas to exit from tubing 21 without having to flow through pump 70.

Major components associated with and related to electric motor 50 and submersible pump 70 include cable anchor assembly 40, electrical connector means 45, and locking module assembly 60. Cable anchor assembly 40 and electrical connector means 45 are provided to mechanically and electrically connect submersible pump 70, electric motor 50, and related components to power cable 30. Locking module assembly 60 can be releasably engaged with landing nipple 21. Locking module assembly 60 also provides discharge head 61 with a plurality of discharge ports 62 to direct well fluid discharged from pump 70 to the well surface via tubing 20. Each of these components will be discussed in more detail.

Figure 2A:
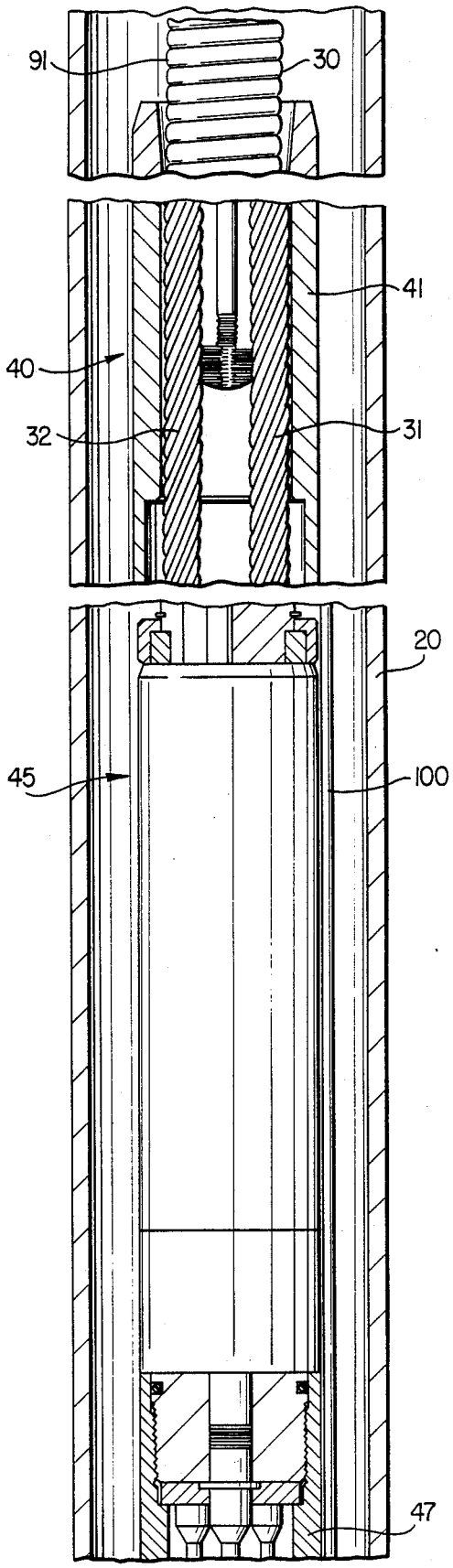
FIGS. 2A through 2F are continuation drawings, partially in elevation and partially in longitudinal section with portions broken away, illustrating a power cable, cable anchor assembly, electrical connections, electric motor, locking module assembly, pump discharge head, and pump with the fluid flow path(s) of the present invention.
Figure 3A:
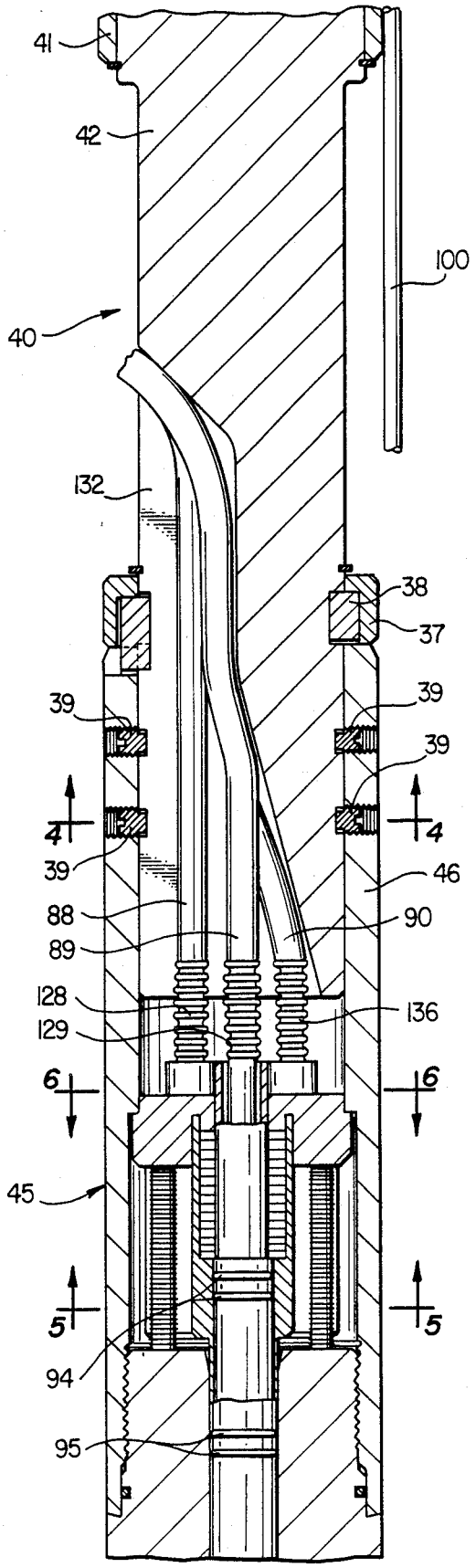
FIGS. 3A and 3B are enlarged continuation drawings, partially in elevation and partially in longitudinal section with portions broken away, illustrating the cable anchor assembly and electrical connector means of FIG. 2A in more detail.

Cable anchor assembly 40 is shown in FIGS. 1, 2A and 3A. Power cable 30 preferably includes two wire ropes 31 and 32 which can be securely engaged with cable anchor assembly 40 as taught by U.S. Pat. No. 4,749,341. Drum sockets (not shown) or helical splice rod terminations as shown in FIG. 2A are well known means for securing wire ropes 31 and 32 within cable anchor assembly 40.

Cable anchor assembly 40 has two major subassemblies tubular housing 41 and solid mandrel 42. Tubular housing 41 is a generally hollow, cylindrical sleeve sized to fit over the terminal end of power cable 30. Solid mandrel 42 is securely locked into the end of tubular housing 41 opposite from power cable 30. Various types of threaded connections and locking rings or set screws (not shown) may be used to satisfactorily engage housing 41 with mandrel 42. Preferably, the connections of power cable 30 within housing 41 and housing 41 to mandrel 42 are keyed to prevent relative rotation between these items.

Window (longitudinal slot) 43 is machined through the exterior of tubular housing 41 intermediate the ends there. Power cable 30 preferably includes three electrical conductors 88, 89 and 90 plus fluid line 100 which extend through window 43 to components therebelow. Fluid line 100 is a relatively small diameter conduit similar to control fluid lines associated with surface controlled subsurface safety valves.

Figure 3B:
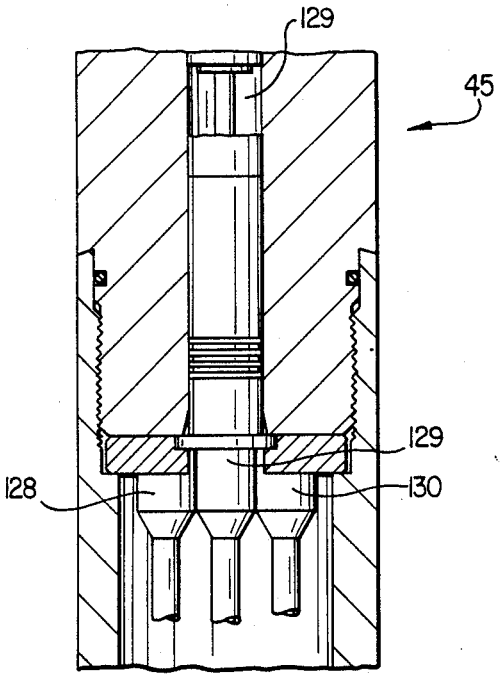
Figure 4:
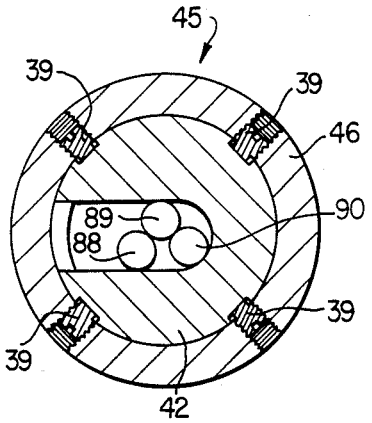
FIG. 4 is a drawing in horizontal sectional taken along the lines 4—4 of FIG. 3A.
Figure 5:
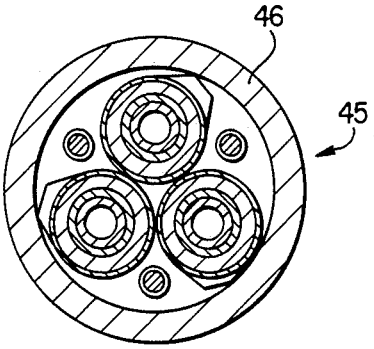
FIG. 5 is a drawing in horizontal sectional taken along the lines 5—5 of FIG. 3A.
Figure 6:
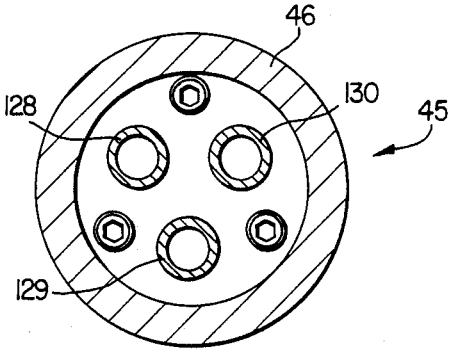
FIG. 6 is a drawing in horizontal sectional taken along the lines 6—6 of FIG. 3A.

Electrical connector means 45 includes general cylindrical, hollow sleeve 46 which is mechanically attached to solid mandrel 42 by locking rings 37 and 38 by set screws 39. A similar mechanical connection can be used to attach tubular housing 41 to solid mandrel 42. FIGS. 3A and 3B show details concerning the internal design of electrical connector means 45 and will be discussed later in more detail.

Figure 2B:
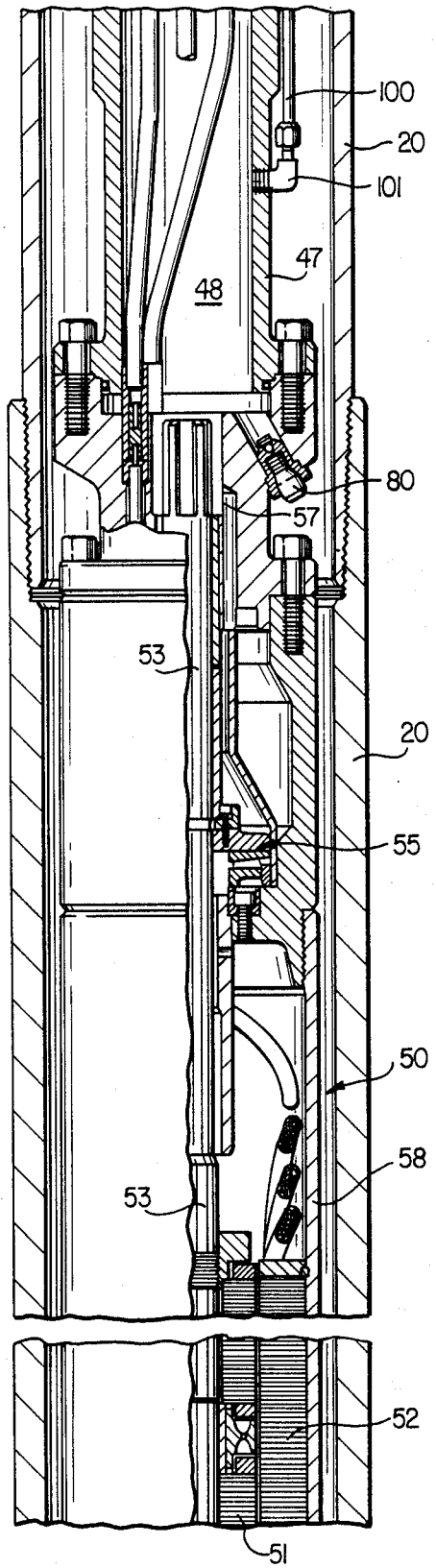
Figure 2C:
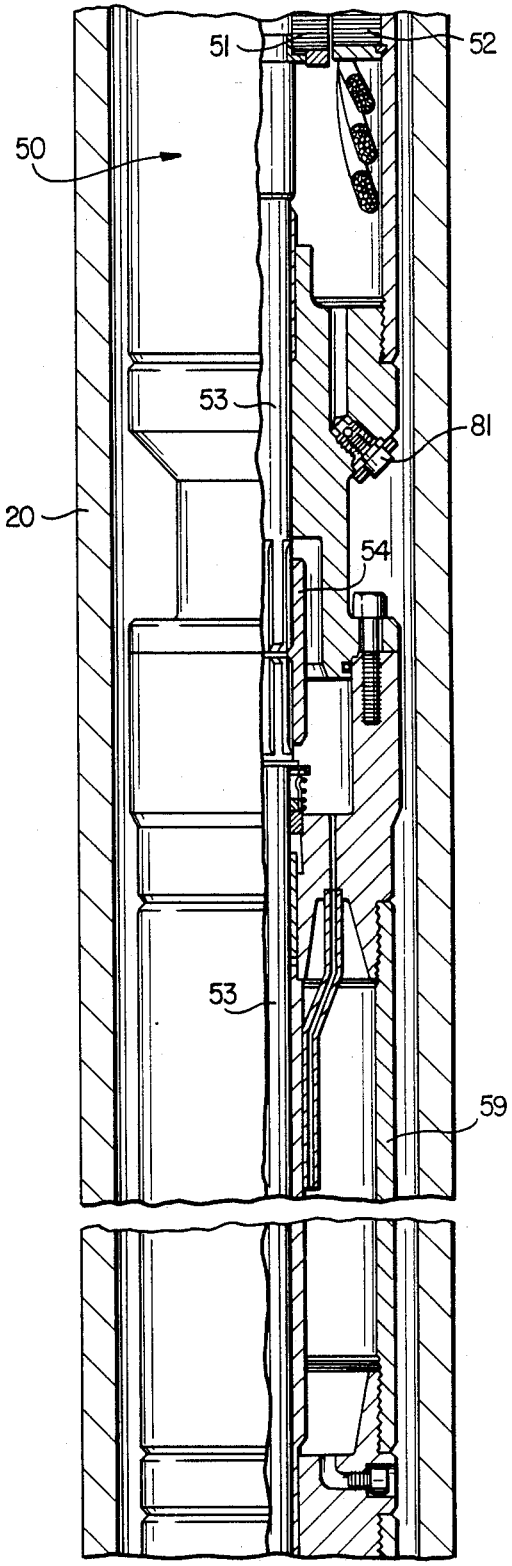

Electrical energy from power cable 30 is supplied via conductors 88, 89 and 90 through electrical connector means 45 to electrical motor 50. Armature and stator windings 51 and 52 respectively rotate shaft 53 in response to the electrical energy supplied by power cable 50. FIGS. 2B and 2C show a typical electrical induction three-phase AC downhole motor used as the prime mover for centrifugal pump 70. Shaft 53 is rotatably connected to pump 70 by several splined connections 54. Shaft 53 is supported by both thrust bearings such as shown at 55 in FIG. 2B and radial bearing as shown at 56 in FIGS. 2D. The number, type, and location of bearings can be varied depending upon the requirements of downhole motor 50 and submersible pump 70. Radial bearing 56 also includes a fluid seal or barrier to prevent undesired fluid flow along the exterior of shaft 53. FLuid line 100, an important feature of the present invention, allows various fluids to be injected from the well surface via power cable 30 to protect bearings 55 and 56 and other critical components in motor 50.

Locking module assembly 60 performs three critical functions with respect to the well completion system for downhole submersible pump 70 and its associated components. These functions are partially supporting the weight of pump 70 and associated components, directing fluid flow and protecting power cable 30.

A plurality of flexible collet fingers 121 are provided on the exterior of locking module assembly 60 to releasably engage groove or recess 122 on the interior of landing nipple 21. Engagement of collet fingers 121 with groove 122 allows a selected amount of upward tension to be placed on power cable 30 without releasing locking module assembly 60 from landing nipple 21. The amount of tension (if any) is a function of the well head connection (not shown) for power cable 30 and the weight of the downhole components.

Fluid seals 119 on the exterior of locking module assembly 60 engage smooth bore 23 of landing nipple 21 to prevent undesired fluid flow around the exterior of locking module assembly 60. Fluid seals 119 block formation fluids exiting from discharge ports 62 from flowing downwardly towards the inlet for pump 70. Fluid seals 119 ensure the formation fluids exiting from discharge ports 62 flow upwardly within production tubing 20 to the well surface.

No-go shoulder 111 on the interior of landing nipple 21 and matching no-go shoulder 63 on the exterior of locking module assembly 60 cooperate to support the weight of pump 70 and associated components such as motor 50. The amount of weight depends upon the tension (if any) placed in power cable 30. No-go shoulders 111 and 63 are positioned relative to collet fingers 121 and groove 122 to allow engagement of collet fingers 121 in groove 122 before shoulders 111 and 63 contact each other. The distribution of weight supported by power cable 30 and no-go shoulders 111 and 63 depends upon several factors such as depth of landing nipple 21, fluid pressure exiting discharge ports 62 as compared to pump inlet pressure, weight of pump 70, motor 50, and inlet piping (if any) attached to pump 70.

By installing locking module assembly 60 in place against an upward force below a selected amount, power cable 30 may be placed in tension at the well surface. This tension will prevent damage to cable 30 from possible bending at its attachment with cable anchor assembly 40.

Hollow, tubular sleeve 47 is engaged below electrical connector means 45 to provide fluid receiving chamber 48. Sleeve 47 also provides part of the mechanical connection between electrical motor 50, cable anchor assembly 40 and electrical connector means 45. Fluid line 100 from power cable 30 is connected to chamber 48 by threaded fitting 101. Fluid receiving chamber 48 is part of a fluid flow path which extends through electrical motor 50 and its related components. The fluid flow path receives treating fluid such as lubricating oil, mineral oil based lubricants, corrosion inhibitor or di-electric fluids from power cable 30 via fluid line 100. The fluid flow path can be used to purge harmful well fluids from the interior of motor 50 and to provide a constant bath to protect critical bearings and fluid seals. A suitable opening such as passageway 57 is provided between the various sections of electrical motor 50 to communicate treating fluid from chamber 48 therewith. Passageway 57 extends from receiving chamber 48 into motor 50 around the upper end of shaft 53.

A plurality of relief valves such as shown at 80, 81, and 82 are threaded into electric motor 50 and its related components to allow treating fluid to exit therefrom. Electric motor 50 and its related components are defined in part by separate cylindrical housings such as 58 and 59. Preferably, relief valve 80, the closest to fluid receiving chamber 48, will have the highest setting pressure. Each relief valve, below valve 80, will have an incrementally lower setting pressure. Thus, as treating fluid is introduced into motor 50, the fluid will exit from the lower valve first. Therefore, the relief valves below valve 80 serve as purge valves to remove undesired fluids from within motor 50.

Power cable 30 includes wire ropes 31 and 32 on either side of multiple electrical conductors 88, 89 and 90 and fluid line 100. The electrical conductors, wire ropes and fluid line are contained within an envelope of relatively stiff but flexible material 91. The cable is available from The Kerite Comapny, Seymour, Connecticut. Preferably, at least one side of power cable 30 at its lower end has a pair of flats which may be engaged to prevent rotation between cable anchor assembly 40 and power cable 30. FIG. 2A shows power cable 30 with envelope 91 stripped away from its lower end, leaving bare the electrical conductors and wire ropes 31 and 32.

Figure 2D:
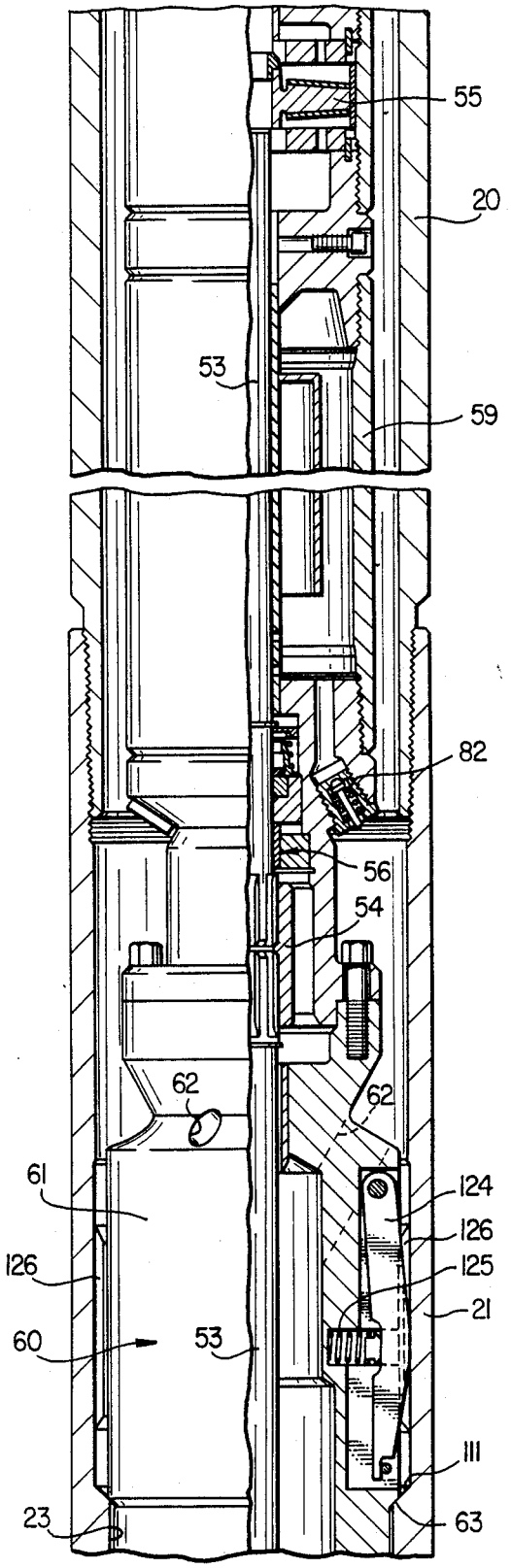
Figure 2E:
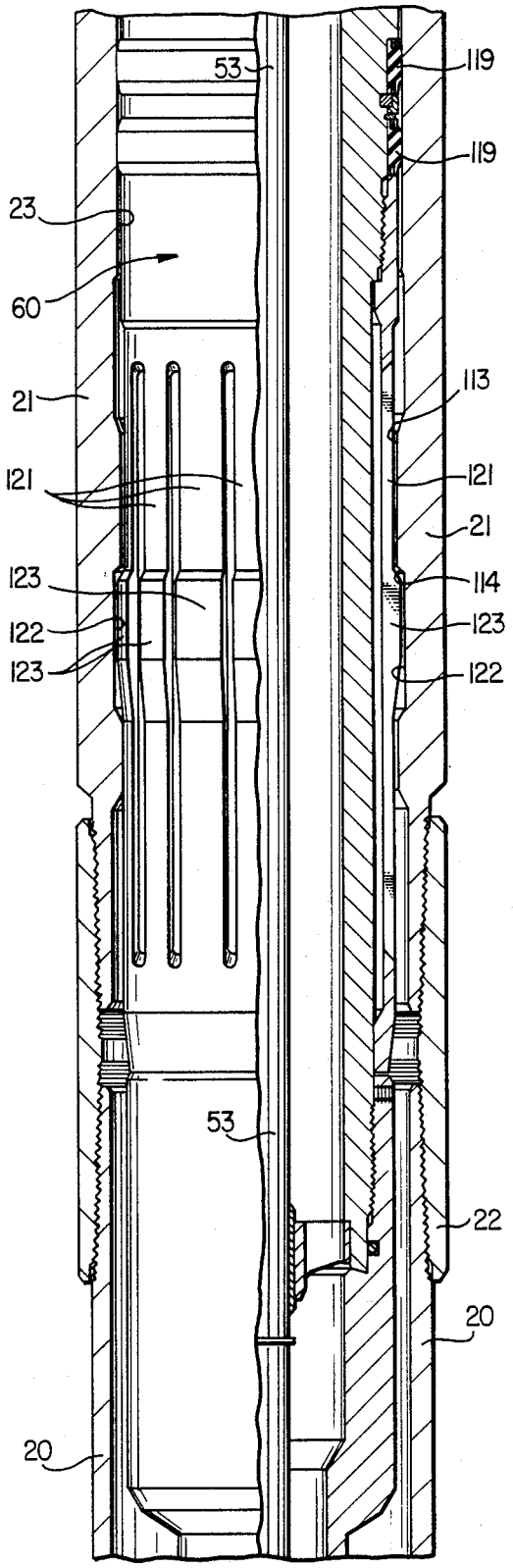
Figure 2F:
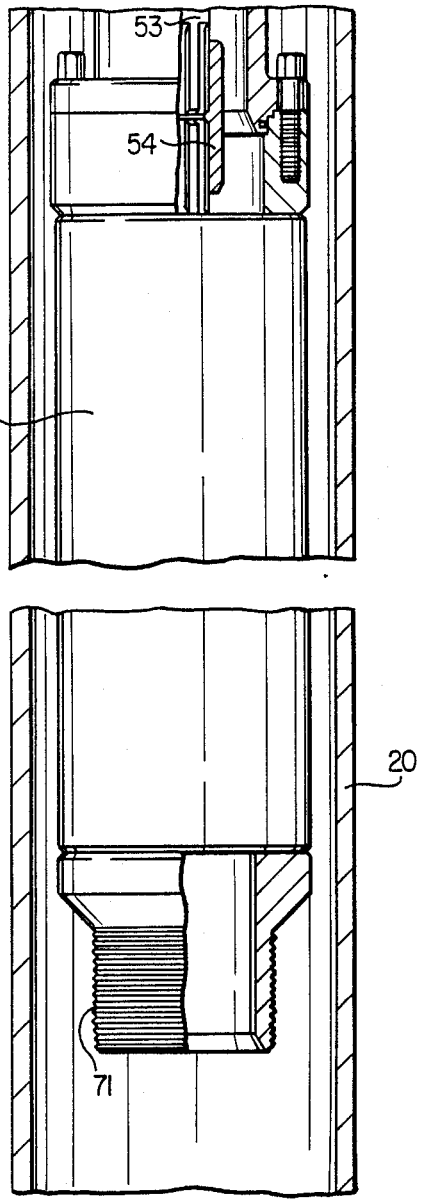

FIGS. 2D and 2E illustrate landing nipple 21 with an upwardly facing no-go shoulder 111, against which locking module assembly 60 rests. Below no-go shoulder 111, a smooth bore 23 provides a seal area. Below the seal area, an enlarged wall section provides land 113 (reduced inside diameter) which terminates at its lower end in downwardly facing beveled shoulder 114 for engagement by collet fingers 121.

Locking module assembly 60 is provided with a sealing system indicated generally at 119. A plurality of collet fingers 121 are provided on the exterior of locking module assembly 60 below seals 119. Collet fingers 121 are supported at both their top and bottom ends. Collet heads 123 are formed by an enlarged outside diameter portion intermediate the ends of collet fingers 121. Collet heads 123 are sized to be received in groove 122 of landing nipple 21. Collet heads 123 engage land 113 during the installation of submersible pump 70 in production tubing 20. After collet heads 123 pass shoulder 114, they snap into the position shown in FIG. 2E and resist upward movement of locking module assembly 60. The surface angles on the exterior of collet heads 123 are selected to permit easy insertion of locking module assembly 60 into landing nipple 21 and more difficult withdrawal. For instance, it is preferred that less than one thousand pounds of force be required to move locking module assembly 60 downhole to the position shown in FIGS. 2D and 2E and collapse collet fingers 121 as they move past land 113.

Seal bore 23 has a substantial length and the lower end of the seals 119 preferably engage bore 23 prior to collet fingers 121 engaging land 113. Thus, if a problem is encountered in moving locking module assembly 60 downwardly to its latched position, tubing 20 may be pressurized and the pressure above locking module assembly 60 utilized to force it downwardly and latch collet fingers 121 in place. It is preferred that a substantial force be required to move locking module assembly 60 upwardly and compress collet fingers 121. This upward force should be at least approximately five thousand pounds and preferably on the order of ten thousand pounds. By providing a resistance to upward movement of at least approximately five thousand pounds cable 30 may be placed in substantial tension and avoid prior art problems of cable failure adjacent to cable anchor assembly 40.

Locking module assembly 60 (FIG. 2C) includes a key 124 which is urged outwardly by spring 125 into slot 126 in landing nipple 21. More than one slot 126 may be provided. This prevents rotation of pump 70 and related components when motor 50 is operating. If key 124 and slot 126 are not in register when locking module assembly 60 is installed, the reaction force from rotation of armature 51 in motor 50 will rotate locking module assembly 60 until key 124 registers with a slot 126, at which time key 124 will expand and engage to prevent further rotation of locking module assembly 60.

Electrical Connections

Electrical connector means 45 provides both a mechanical link between cable anchor assembly 40 and locking module assembly 60 and an electrical link between power cable 30 and electric motor 50. Electrical conductors 88, 89, and 90 exit from window 43 and enter slot 132 machined in the lower end of solid mandrel 42. Slot 132 protects conductors 88, 89, and 90.

Three electrical penetrators 128, 129 and 130 are disposed within hollow sleeve 46 for electrical engagement with conductors 88, 89 and 90 respectively. Each penetrator 128, 129 and 130 has a plurality of o-ring seals such as shown at 94 and 95 to block undesired fluid flow into electrical connector means 45.

The various components of the downhole completion are held in alignment and against rotation either by a fully made up threaded joints between various sections or by keys, set screws and the like so that, once fully assembled, no relative rotation is possible between the motor 50, pump 70, and cable 30 to protect electrical conductors 88, 89 and 90 between cable 30 and motor 50.

The previous description and drawings illustrate only one embodiment of the present invention. Alternative embodiments will be readily apparent to those skilled in the art without departing for the spirit and scope of the invention as defined by the claims.

What is claimed is:

1. A well completion system for a downhole submersible pump and motor comprising:

a. a production tubing string with a landing nipple forming an integral part thereof and defining in part a downhole location for releasably anchoring a submersible pump and related components within the production tubing string;

b. a power cable having electrical conductors and fluid conductors to supply both electricity and treating fluid from the well surface to the submersible pump and related components; and c. a fluid flow path extending through the submersible pump motor and its related components to receive treating fluid from the power cable.

2. A well completion system as defined in claim 1 further comprising:

a. a downhole electric motor to operate the submersible pump;

b. a cable anchor assembly to electrically and mechanically attach the power cable to the electric motor;

c. a small diameter conduit extending from the exterior of the cable anchor assembly to a fluid receiving chamber above the electric motor; and d. the small diameter conduit supplying treating fluid from the power cable to the fluid flow path.

3. A well completion system as defined in claim 2 wherein the fluid flow path further comprises:

a. the fluid receiving chamber disposed between the cable anchor assembly and the electric motor;

b. an opening from the fluid receiving chamber into the electric motor to communicate treating fluid therebetween; and c. a plurality of relief valves to allow treating fluid to exit from the interior of the electric motor and its related components.

4. A well completion system as defined in claim 1 further comprising:

a. an electric motor for the submersible pump;

b. a cable anchor assembly to mechanically attach the power cable to the electric motor and other related components of the submersible pump;

c. a fluid receiving chamber below the cable anchor assembly;

d. a small diameter conduit extending from the exterior of the cable anchor assembly to the fluid receiving chamber to supply treating fluid from the power cable to the chamber;

e. separate cylindrical housings generally defining the exterior of the electric motor and each related component;

f. an opening from the fluid receiving chamber into the electric motor to communicate treating fluid therebetween;

g. similar openings between other components of the electric motor to communicate treating fluid therebetween; and h. a relief valve extending through each housing to allow treating fluid to exit from the interior of the respective housing.

5. A well completion system as defined in claim 1 wherein the treating fluid is selected from the group consisting of mineral oil, di-electric fluid, lubricating oil, and corrosion inhibitor.

6. The method of installing and operating a downhole submersible pump and motor comprising:

a. attaching the submersible pump with its motor and related components to a power cable having electrical conductors and a fluid conductor to supply both electricity and treating fluid from the well surface to the submersible pump motor and related components;

b. lowering the submersible pump, motor and related components by the power cable through a production tubing string to a landing nipple which defines in part a downhole location for releasably anchoring the submersible pump and related components within the production tubing string; and c. injecting treating fluid from the well surface through the power cable to a fluid flow path extending through the submersible pump motor and its related components.

7. The method of claim 6 further comprising the step of maintaining treating fluid within the submersible pump motor and its related components at a pressure higher than the pressure of well fluids surrounding the exterior of the submersible pump motor and its related components.

8. The method of claim 7 further comprising the step of maintaining treating fluid pressure within the submersible pump motor and its related components above well fluid pressure by a plurality of spring loaded, relief valves which allow treating fluid to exit from the submersible pump motor and its related components and block well fluids from flowing therein.

9. The method of claim 6 further comprising the step of injecting treating fluid from the well surface into the pump motor and its related components before supplying electrical power to the pump motor.

10. The method of claim 6 further comprising the step of maintaining a constant bath of lubricating oil within selected portions of the submersible pump motor.

* * * * *